United States Patent [19]

Torigata et al.

[11] Patent Number: 4,552,743

[45] Date of Patent: Nov. 12, 1985

[54] PROCESS FOR PRODUCING CARBON FIBER

[75] Inventors: Hajime Torigata; Atsushi Sumida; Nobuyuki Matsubara, all of Ehime, Japan

[73] Assignee: Toray Industries, Inc., Tokyo, Japan

[21] Appl. No.: 564,535

[22] Filed: Dec. 22, 1983

[30] Foreign Application Priority Data

Dec. 22, 1982 [JP] Japan ..... 57-223887

[51] Int. Cl.[4] ..... D01F 9/12

[52] U.S. Cl. ..... 423/447.7; 423/447.1; 423/447.8; 264/29.2

[58] Field of Search ..... 423/447.1, 447.4, 447.5, 423/447.6, 447.7, 447.8, DIG. 6; 264/29.2, 29.3; 208/44

[56] References Cited

U.S. PATENT DOCUMENTS 4,100,004 4/1978 Moss et al. ..... 423/447.4

4,259,307 3/1981 Maruyama ..... 423/447.4

OTHER PUBLICATIONS

John C. Olsen Unit Processes and Principles of Chemical Engineering 1932, pp. 1-3.

*Primary Examiner*—John Doll

*Assistant Examiner*—Robert M. Alway

*Attorney, Agent, or Firm*—Armstrong, Nikaido, Marmelstein & Kubovcik

[57] ABSTRACT

A process for producing carbon fiber is disclosed, which comprises a preoxidation step for heating precursor fibers in an oxidizing atmosphere and converting them into partially oxidized fibers, an oxidizing step for heating the partially oxidized fibers in an oxidizing atmosphere and converting them into oxidized fibers, and a carbonization step for heating the oxidized fibers in an inert atmosphere and converting them into carbonized fibers, in which in the preoxidation step the precursor fibers are heated at a temperature of about 200° to 250° C. and in which a portion or the whole of the exhaust gas from the oxidation step is supplied into the preoxidation step as the oxidation atmosphere gas and the exhaust gas from the preoxidation step is subjected to a burning treatment.

9 Claims, 5 Drawing Figures

PROCESS FOR PRODUCING CARBON FIBER

BACKGROUND

This invention relates to a process for producing carbon fiber, and more particularly it relates to a process for the industrial production of carbon fiber which process is typified by energy saving and improved operation stability in the production of carbon fiber.

Hitherto, carbon fibers have been produced by a process comprising an oxidation step in which precursor fibers such as acrylic fibers, cellulose fibers or pitch fibers are heated in an oxidizing gas atmosphere such as air of 200° to 400° C. and converted into oxidized fibers or infusibilized fibers (hereinafter referred to simply as oxidized fibers), and a carbonization step in which the oxidized fibers are further heated in a high-temperature atmosphere of inert gas such as nitrogen, argon, or helium and thereby converted into carbon or graphite fibers (hereinafter referred to simply as carbon fibers).

Gas exhausted from these oxidation and carbonization steps contains a large variety of compounds including oxidation and pyrolysis products of the precursor and oxidized fibers, and release of exhaust gas containing these compounds into the atmosphere presents serious problems concerning especially atmospheric air pollution and environmental hygiene. Further, high-boiling compounds such as pyrolyzates are contained abundantly in the high-temperature exhaust gases from the above oxidation and carbonization steps, and these compounds tend to condense to cause problems such as choke-up of piping unless the temperature of the gases is maintained higher than the condensation point of these compounds. Thus, industrial disposal of these gases has been a key point for the industrial production of carbon fibers.

The present inventors have pursued assiduous studies on the treatment of exhaust gas in the production of carbon fibers and, as a result, have found that the principal constituents of the exhaust gas in the oxidation step are oils released in the course of heat treatment of precursor and oxidation products, and these materials easily condense in an atmosphere below 200° C. to form tar-like matter; that, since the weight loss on heating of the precursor itself in the oxidation step is usually about 3 to 5%, the calorific value of the gas exhausted from the oxidation step (hereinafter referred to as oxidation exhaust gas) is merely of the order of several tens of kcal/m$^3$ under normal conditions (0° C., 1 atm.) and hence such gas has little self-combustibility; and that, in the carbonization step in which the oxidized fibers formed in the oxidation step are heated in an inert atmosphere, there takes place a weight loss upon heating of at least about 40% by weight based on the weight of the precursor, and the gas exhausted from this carbonization step (hereinafter referred to as carbonization exhaust gas) is rich in pyrolyzates. Most of the pyrolyzates are produced in the recarbonization step in which the oxidized fibers are precarbonized and where the temperature is maintained in the range of 300° to 900° C., and the pyrolyzates produced in said precarbonization step contain materials (tar matter) which condense in an atmosphere of below 450° C., while in the carbonization step where the temperature is maintained above 900° C., only a small amount of pyrolyzates is produced and it contains essentially no such tar matter.

In the conventional methods for treatment of exhaust gases in the production of carbon fibers, the oxidation exhaust gas is usually made pollution-free by an oxidizing catalyst and then released into the atmosphere. However, when a silicone oil or an organosilicone is used as treating agent for the precursor fibers, since many of the pyrolyzates produced in this oxidation step have a poisoning action against the oxidizing catalyst, the catalyst life is shortened so that the catalyst must be frequently exchanged, resulting in a reduced working efficiency and an elevated cost for the catalytic treatment.

On the other hand, the gas exhausted from the carbonization step, that is, carbonization exhaust gas, is either similarly treated by an oxidizing catalyst and then released into the atmosphere, or burned by mixing with an oxidizing gas.

However, when a silicone oil or an organosilicone is used as treating agent for the precursor fibers, the catalytic treatment of the carbonization exhaust gas involves many problems because of the high content of pyrolyzates in the exhaust gas. That is, in addition to the problems found in the catalytic treatment of the oxidation exhaust gas as mentioned above, interruption of carbonization treatment is another problem which leads to an even greater deterioration of workability and greater loss of energy than are caused by interruption of the oxidation step. The burning treatment of the carbonization exhaust gas also presents a problem. Although the calorific value of the exhaust gas is in the order of several thousand kcal/m$^3$ under normal conditions (0° C./atm.) or higher, this exhaust gas has little combustibility because it contains no oxidizing gas. Therefore the exhaust gas can not be immediately subjected to the burning treatment. It is necessary to add an oxidizing gas such as air (which has been previously heated to a required temperature) to give the resultant gas mixture a sufficient combustibility for the burning treatment. In this case, in order to prevent condensation of the pyrolyzates contained in the exhaust gas, the oxidizing gas must be preheated before it is mixed with the exhaust gas. Naturally, additional equipment is necessitated for such a treatment. Thus, this type of method is very disadvantageous in its industrial applicability with respect to equipment cost and energy saving.

It is known that a carbon fiber manufacturing method using as precursor an acrylic fiber impregnated with silicone oil is capable of effecting smooth opening of fiber bundles when the precursor fibers are heated and oxidized in an oxidizing atmosphere to thereby convert them into oxidized fibers, and can provide carbon fibers having excellent properties with little tendency to cause fusion of individual fibers (Japanese Patent Laid-Open Nos. 10175/1978 and 131032/1979). However, when the precursor fibers impregnated with such silicone oil or so-called organosilicone are heated in an oxidizing atmosphere, vaporized silicone and pyrolyzates thereof are formed abundantly in the exhaust gas, and these products excessively shorten the life of catalyst, especially the oxidizing catalyst, to elevate the cost for the exhaust gas treatment. Further, once such products are accumulated in an exhaust gas treating system, it is extremely difficult to remove them by any cleaning means and, in some cases, the exhaust gas treating system itself becomes unoperative.

SUMMARY

An object of this invention is to achieve energy saving and operational stability by decreasing the oxidation exhaust gas as much as possible, and to achieve energy saving by treating concurrently the oxidation exhaust gas and the carbonization exhaust gas, and to achieve operational stability and improvement of properties as will be discussed later by releasing the exhaust gas from the precarbonization step from the middle part of the precarbonization furnace.

Another object of this invention is to provide a process for producing carbon fibers which process is free of the above-mentioned prior art problems, especially those relating to the exhaust gas treatment, in the industrial production of carbon fibers by using acrylic fibers impregnated with silicone oil as precursor fibers and which is therefore capable of providing high-performance and high-quality carbon fibers.

These objects of the present invention can be accomplished by providing a carbon fiber producing process comprising an oxidation step in which precursor fibers are heated in an oxidizing atmosphere to convert them into oxidized fibers and a carbonization step in which said oxidized fibers are further heated in an inert atmosphere to convert them into carbonized fibers, said process also incorporating a preoxidation step in which the precursor fibers are heated in an oxidizing atmosphere of around 200° to 250° C. to convert them into partially oxidized fibers with a water retention of 1 to 3% by weight, wherein part or the whole of the oxidation exhaust gas from the separate oxidation step is supplied to the preoxidation step as an oxidizing atmosphere gas for said step, and the gas exhausted from this preoxidation step is subjected to a burning treatment.

THE DRAWINGS

THE PREFERRED EMBODIMENTS

Figure 1:
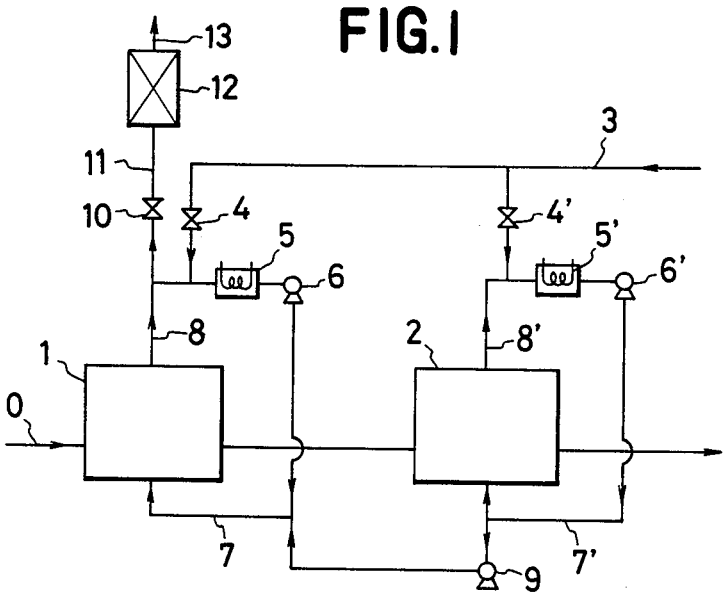
FIG. 1 is a flow chart showing the oxidation step in one embodiment of the present invention.

A prominent feature of this invention is the incorporation of a preoxidation step in which the precursor fibers are heated in an oxidizing atmosphere maintained at a temperature within the range of around 200° to 250° C., preferably 220° to 245° C., to thereby convert them into imperfectly oxidized fibers having a water retention of about 1 to 3%, preferably 2 to 3% by weight.

This preoxidation treatment is intended to effectuate almost complete evaporation and pyrolysis of oils adhering to the precursor fibers, but it should be noted that if the ambient temperature in this preoxidation step exceeds 250° C., individual precursor fibers tend to fuse together, making it hardly possible to produce carbon fibers with excellent properties, while if the ambient temperature is below 200° C., no satisfactory evaportation and pyrolysis of the oil may be attained and also a long time is required for this preoxidation treatment.

Also, if the water retention of the precursor fibers which have been subjected to the preoxidation treatment is less than 1%, no complete removal of the oils, especially silicone oil, adhering to the precursor fibers can be attained, and it becomes impossible to realize the object of improving the treating efficiency of the exhaust gas formed in the course of the production of carbon fibers by the incorporation of said preoxidation step of this invention as will be discussed later, while if the water retention exceeds 3%, the oils are removed almost completely, and further preoxidation treatment is unnecessary. More specifically, since the tar matter in the precursor fibers is almost entirely eliminated in the preoxidation step, the periodic cleaning of the furnace for the removal of the tar matter is required only for the preoxidation step (furnace), so that the working efficiency of the whole process is improved. It is further possible to control preoxidation conditions such as the oxidizing gas feed by detecting the tar matter contained in the oxidizing gas circulated into the preoxidation furnace and to thereby realize a prolongation of the periodic inspection interval.

The obtained preoxidized fibers having a water retention of 1 to 3% are incompletely oxidized, so that if they are immediately carbonized, no carbon fibers with excellent properties can be obtained. Therefore, they need to be further heated and oxidized in an oxidizing atmosphere to covert them into oxidized fibers with a water retention of at least 5%. The treatment conditions in this oxidation step are not specifically defined and any suitable conditions that allow conversion into oxidized fibers having a water retention of at least 5% may be used. Preferably the fibers are heated at 240° to 280° C. in an oxidizing atmosphere such as air for a period of 10 to 120 minutes. One of the salient features of this invention is to utilize the oxidation exhaust gas as the oxidizing atmosphere gas in this preoxidation step. Since the oxidation exhaust gas in this invention is substantially cleared of impurities such as oils and their pyrolyzates produced from the precursor fibers in the preoxidation step, it is substantially free from such impurities and also its temperature is usually maintained higher than the oxidation atmosphere temperature in the preoxidation step, so that it can be immediately supplied (with no need for heating) as the atmosphere gas for the preoxidation step. Therefore, it is possible to save energy by reducing the volume of the oxidation exhaust gas. This volume is less than the total gas volume involved in separate treatments of the exhaust gases from the preoxidation step and oxidation step.

As described above, the oxidation exhaust gas is usually immediately circulated for reuse as the atmosphere gas in the preoxidation step, but because of the very low impurity content or insignificantly small poisoning action of the impurities on the catalyst, said exhaust gas may be subjected to a catalytic treatment before it is supplied to the preoxidation step.

The oxidation exhaust gas supplied to the preoxidation step may be mixed with fresh gas such as air in an amount of 0 to 4 parts (by volume) of fresh gas to 1 part (by volume) of said exhaust gas, although the ratio depends on the treatment conditions in the preoxidation step. Mixing of fresh gas in excess of 4 parts of fresh gas to 1 part of exhaust gas is undesirable because the gas balance in the preoxidation step is such that the amount of the oxidation exhaust gas removed from the oxidation step is reduced. This slower removal of oxidation exhaust gas has the effect of increasing the impurity concentration in the oxidation step.

The oxidation step in this invention will now be described in more detail with reference to the accompanying drawings.

FIG. 1 is a flow chart showing a mode of practice of the oxidation step in the present invention.

In the drawing, reference numeral 0 indicates precursor fibers, 1 and 2 a heat-treating furnace for preoxidation and an oxidation furnace, respectively, 3 a fresh air feed line, 4 and 4' air feed adjusting valves, 5 and 5' heaters, 6, 6' and 9 blowers, 7 and 7' circulation gas feed lines, 8 and 8' circulation gas take-out lines, 10 an exhaust gas adjusting valve, 11 a gas exhaust line, 12 exhaust gas treating equipment, and 13 a gas release line (releasing the treated gas into the atmosphere).

As shown in the drawing, the precursor fibers 0 are oxidized first in the thermal preoxidation furnace 1 and then in the oxidation furnace 2.

The oxidation exhaust gas coming from the furnace 2 through the circulation gas take-out line 8' is mixed with fresh air supplied from the outer air feed line 3 with its feed rate adjusted by the air feed adjusting valve 4', and the obtained gas mixture is heated to a predetermined temperature by the heater 5' and divided into two portions by the blower 6' while passing through the circulation gas feed line 7'. One portion of said gas is supplied into the oxidation furnace 2 while the remainder is mixed with the circulation gas from the furnace 1 and fed back into the furnace 1 as an atmosphere gas.

On the other hand, the gas discharged from the furnace 1 through the circulation gas take-out line 8 is divided into two portions, and the major part of it is, as such or after being mixed with fresh air from the outer air suction line 3, heated to a predetermined temperature by the heater 5 and supplied into the furnace 1 by the blower 6 through the circulation gas feed line 7. As described before, the divided exhaust gas from the furnace 2 is mixed in said feed line 7. Another part of the exhaust gas from the furnace 1 is passed through the exhaust line 11 while its rate is adjusted by the exhaust gas adjusting valve 10 to flow into the exhaust gas treating equipment where said gas is usually directly subjected to a burning treatment, and the treated gas is released into the atmosphere through the release line 13.

The gas exhaust from the furnace through the circulation gas take-out line 8 is controlled at a rate that can regulate the air velocity in the furnace 1 to a specified level and, in order to keep the impurity concentration in the furnace 1 below a given level, part of said exhaust gas is taken out for the burning treatment while the remainder is circulated into the furnace 1 through the circulation gas feed line 7.

In this case, the oxidation exhaust gas is preferably mixed in the circulation gas feed line 7 so that the mixed gas is supplied into the furnace 1. Supply from a separate line is undesirable because, in such a case, a temperature difference can be produced in the furnace 1.

Figure 2:
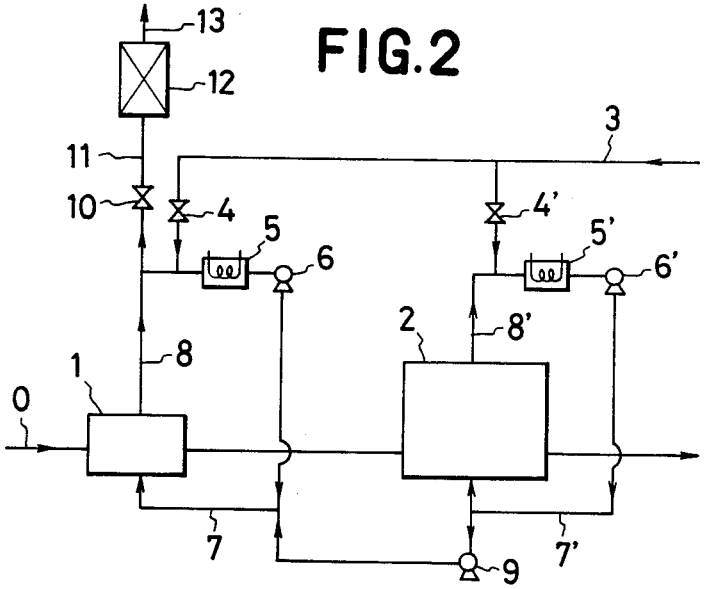
FIG. 2 is a flow chart showing the oxidation step in another embodiment of this invention.
Figure 3:
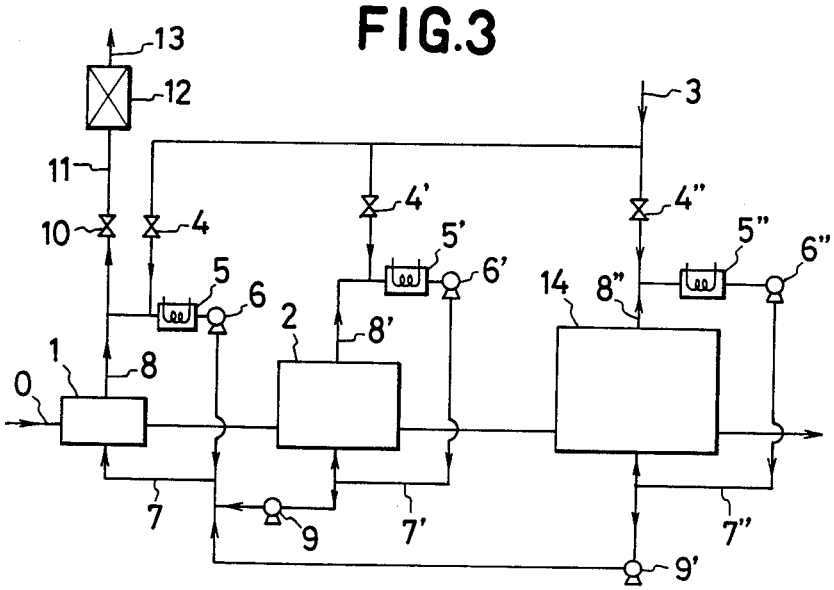
FIG. 3 is a flow chart showing the oxidation step in still another embodiment of this invention.

FIG. 2 and FIG. 3 are flow charts showing other embodiments of the oxidation step according to this invention.

FIG. 3 illustrates an embodiment where the capacity of the furnace 1 was reduced. The furnace 1 to furnace 2 volume ratio may be typically ½ to 1/5 although this range is not essential.

The merits in use of such furnaces in the oxidation step are that the tendency to produce a temperature difference in the furnace 1 is lessened and that the removal of tar matter deposited at the fiber inlet and outlet portions of the furnace 1 becomes easy.

In the embodiment of FIG. 3, the oxidation step is performed in three stages and the furnace capacity is increased successively from one furnace to the other. Exhaust gases from the oxidation steps in the furnaces 2 and 14 are each divided into two portions, and the corresponding portions of the divided gases are mixed and supplied into the preoxidation furnace 1. The volume ratio of the respective furnaces in this case, although not specifically defined, is usually as follows:

furnace 1/furnace 2/furnace 3=0.2/0.8/1~0.3/0.6/1

Figure 4:
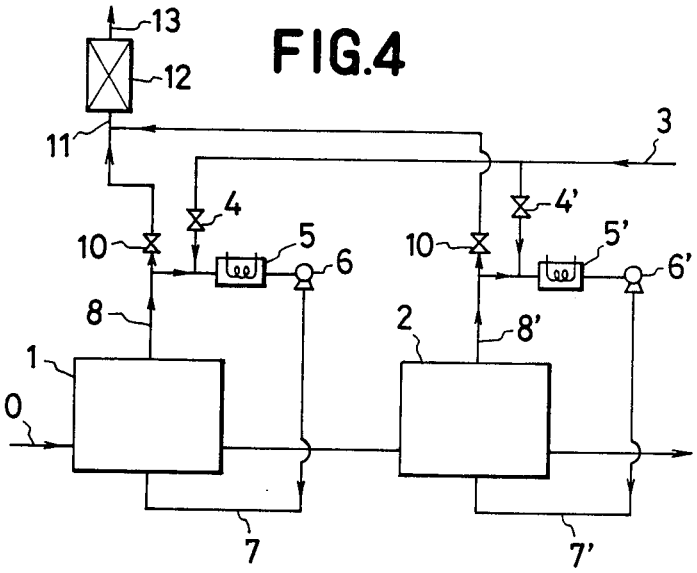
FIG. 4 is a flow chart showing the oxidation step in a prior art method.

FIG. 4 is a flow chart of a prior art oxidation step. In the system of FIG. 4, fresh air supplied from the fresh air feed line 3 is passed through the valves 4, 4', mixed with the divided portions of the exhaust gases from the oxidation furnaces 1 and 2, then further passed through the heaters 5, 5', blowers 6, 6' and circulation gas feed lines 7, 7' and supplied into the furnaces 1, 2. The exhaust gases from the furnaces 1 and 2 are each divided into two portions, and one portion thereof is circulated while the other portions of the respective gases are passed through the exhaust gas adjusting valves 10, 10', then joined together, treated in the exhaust gas treating equipment 12 and then released into the atmosphere. In this system, both furnaces 1 and 2 are gradually contaminated by the exhaust gas to become unable to operate normally for a long time. Also, the circulation gas composed of a mixture of fresh air and the exhaust gas needs to be adjusted in its temperature, and the energy loss due to heating of fresh air is great.

The carbonization exhaust gas, despite its high calorific value in the order of several thousand kcal/Nm$^3$ and a high content of pyrolyzates in the atmosphere gas as mentioned above, is per se incombustible because it is an inert gas. Therefore, for the burning treatment of this exhaust gas, it is necessary to supply a large amount of an oxidizing gas, generally air. This necessitates additional equipment for air supply. Further, air must be supplied in a heated state in order to prevent the condensation of tar-like matter, for which a large volume of energy is required. Moreover, the exhaust gases from the oxidation and carbonization steps contain oils as well as a wide variety of compounds originating in the pyrolyzates of the precursor, and the condensation of these compounds causes break of fibers in the carbon fiber production process, and degradation of the quality and strength of the obtained carbon fibers as well as other undesirable matters.

In the present invention, the gas combustibility can be afforded by mixing the carbonization exhaust gas with the preoxidation exhaust gas, especially one having a calorific value of 5 to 20 kcal/Nm$^3$, an oxygen concentration of at least 12%, preferably above 20%, a temperature of about 200° to 350° C. and a content of the tar-like matter of about 0.01 to 2.0 g/Nm$^3$. The carbonization exhaust gas is not limited to one discharged from the carbonization step; it may be one discharged from a pregraphitization step. More specifically, the carbonization exhaust gas includes the one from the precarbonization step where the oxidized fibers are preliminarily carbonized in an inert atmosphere of 300° to 900° C., the one from the carbonization step where the fibers are carbonized in an inert atmosphere of 700° to 1,600° C. and the one obtained from the graphitization step where the fibers are treated in an inert atmosphere of a higher temperature.

Figure 5:
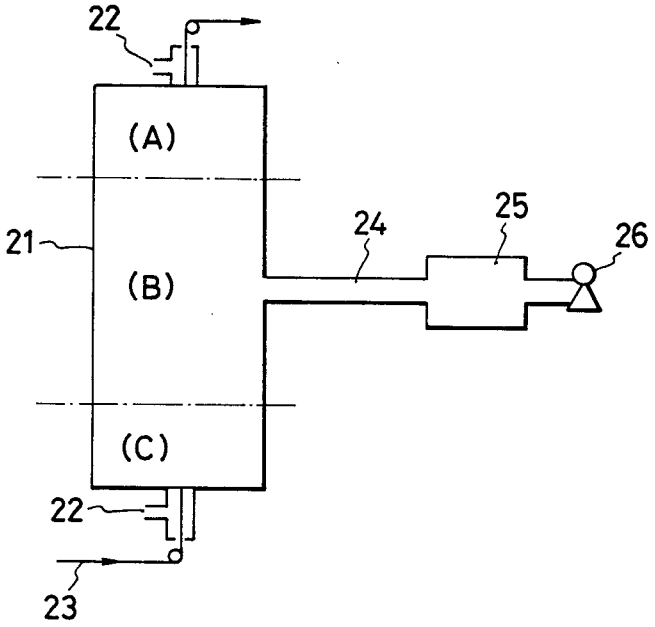
FIG. 5 is a schematic side elevational view of an example of a vertical carbonization furnace used in the present invention.

FIG. 5 is a schematic side elevational view of one example of the vertical carbonization furnace. In the drawing, the oxidized fibers 23 are introduced into the carbonization furnace 21 bottomwise thereof and taken out of the top. The inside of the furnace is so designed that fibers introduced into the furnace are exposed to higher temperatures successively as they advance upwards along their course of travel in the furnace, that is, it has a temperature profile represented, for instance, by 300°-400° C. in the bottom block C having an inert gas feed port 22, 400°-600° C. in the middle block B and 600°-1,000° C. in the top-most block A in the drawing. The furnace is evacuated through a gas vent port 24 provided at a middle part of the furnace, and the discharged gas is passed through a suction blower into the preoxidation exhaust gas line. This carbonization gas discharge rate is 20 to 50%, preferably 30 to 40% by volume, based on the amount of the gas supplied into the furnace.

In the case of carbonizing the oxidized fibers by using such a vertical carbonization furnace while introducing an inert gas from the furnace top and releasing it from the bottom, tar matter deposits and accumulates to form scale on the upper part of the furnace due to the chimney effect peculiar to the vertical furnaces, and such scale impairs smooth flow of the inert gas in the furnace to cause a pressure variation in the furnace and also the carbides of such scale cause break or fluffing of travelling fibers. However, in the case of using the carbonization furnace according to this invention, there is little fear of causing such scale problems due to deposition and accumulation of tar matter and it is possible to produce carbon fibers with excellent properties and uniform quality and performance in a stable way.

On the other hand, in using the vertical carbonization furnace by introducing an inert gas from the bottom while releasing it from the furnace top, since the topmost portion of the furnace is heated to a temperature close to the highest temperature attainable in the furnace, the inert gas vent port provided at the topmost portion of the furnace might suffer thermal damage. However, in the carbonization furnace used in this invention, since the inert gas vent port is provided on a middle part of the furnace, said vent port keeps off the highest temperature in the furnace and remains safe from any serious thermal damage.

Also, it is possible in the furnace of FIG. 5 to eliminate the risk of contamination of the fibers travelling in the furnace with the pyrolyzates by allowing the inert gas to flow counter-currently against the fibers.

Thus, the carbonization exhaust gas taken out of the central part of the vertical carbonization furnace has a calorific value higher than 320 kcal/m$^3$ under normal conditions (0° C., 1 atm.) so that when such carbonization exhaust gas is mixed with the preoxidation exhaust gas, almost no fuel is required for the burning treatment of the oxidation exhaust gas. The mixing ratio of the carbonization exhaust gas to the preoxidation exhaust gas is usually 1:1-15 (by volume), preferably 1:1-10. If the mixing ratio of the preoxidation exhaust gas to the carbonization exhaust gas is less than 1, no sufficient amount of oxygen is provided for effecting complete combustion of the carbonization exhaust gas, while if this ratio exceeds 15, a large amount of fuel is required and additional burning treatment equipment is to be of a large scale.

The carbonization exhaust gas which is per se incapable of a direct catalytic oxidation or burning treatment can be safely subjected to the burning treatment by mixing with the preoxidation exhaust gas, but in this case the preoxidation exhaust gas to be mixed is preferably the one maintained at a temperature above 200° C., while the carbonization exhaust gas to be treated is preferably the one which has been discharged from the precarbonization step and is maintained at a temperature above 450° C.

If the temperature of the preoxidation exhaust gas is below 200° C., tar matters produced in the preoxidation step, especially those originating in the oils, are caused to condense, while if the exhaust gas from the precarbonization step is below 450° C., the produced tar matters are also caused to condense to impair the operational stability.

There is no need of specifically regulating the temperature of the exhaust gas from the carbonization step maintained at 700° to 1,600° C. and that of the exhaust gas from the pregraphitization step; usually the gases maintained at a temperature of above 50° C. can be used.

Thus, according to the exhaust gas treating method of this invention, the exhaust gases of different qualities produced in the carbon fiber production process are mixed and subjected to a catalytic or burning treatment, so that this method permits an appreciable energy saving in the exhaust gas treatment and can also minimize deposition and accumulation of the tar matter in the exhaust gas on the inside of the oxidation and carbonization furnaces and on the fibers travelling in these furnaces to realize a stabilized operation of the process. It is further possible with this method to obtain carbon fibers of high performance and high quality.

The precursor used in this invention is not specifically defined, and usually acrylic fibers, especially those treated with silicone oil are preferably used. In this case, the problems in the exhaust gas treatment that are due to the silicone and its pyrolyzates contained in the exhaust gas are eliminated. This is of great industrial significance.

As the silicone oil for use in the treatment of the precursor fibers in this invention, there may be cited various types of silicone oil as disclosed in the U.S. Pat. Nos. 4,009,248 and 4,259,307.

In the case the deposit amount of silicone oil is less than 0.1%, it becomes difficult to obtain a good prevention of inter-fiber or filament fusion and a good opening of fibers in yarn or bundle. When the amount of silicone oil exceeds 5%, there results an increase of the formed silicone and/or its decomposition products in the exhaust gas.

The present invention will now be described in more detail by way of the examples thereof.

In the Examples and Comparative Examples which follow, the concentration of the tar matter in the oxidizing atmosphere and the degree of fluffing and water retention of the oxidized fibers were measured by the following methods.

(1) Tar matter

The oxidizing atmosphere gas was led into a conduit maintained at 200° C. and the tar matter in the gas was adsorbed by the activated carbon in the conduit. The concentration of the tar matter in the oxidizing atmosphere was determined from the weight increment of the activated carbon after adsorption, according to the following formula:

concentration of tar matter =

-continued $$\frac{\text{weight increment (g) of activated carbon}}{\text{amount of gas passed through activated carbon layer}}$$

(2) Fluffing of oxidized fiber

A 6000-denier oxidized fiber composed of 6,000 filaments was placed on a white paper and the number of the fluffs present in the fiber of 1 m in length was counted.

(3) Water retention

The oxidized fiber was placed in a desiccator (25° C. and 81% RH) of an ammonium sulfate solution and the water retention of the fiber after allowing 16-hour moisture absorption by the desiccator was measured.

EXAMPLE 1 AND COMPARATIVE EXAMPLE 1

An acrylic fiber containing 3.0% by weight of a hydrocarbon oil was supplied continuously into a preoxidation furnace at a rate of 100 kg per hour and subjected to an oxidation treatment according to the respective flow systems shown in FIGS. 1, 2, 3 and 4. The oxidation conditions, fluffs of the obtained oxidized fibers, workability and energy consumption in the treatment in each system were examined to obtain the results shown in Table 1. The exhaust gas from the preoxidation treatment was mixed with the preoxidation exhaust gas by using kerosene as a combustion aid and directly subjected to a burning treatment.

As shown in Table 1, Test Nos. 1, 2 and 3 which represent the embodiments of this invention are low in energy consumption. Also, in Test Nos. 2 and 3 in which the time of preoxidation treatment was shortened, little tar matter was deposited on the inlet and outlet portions of the preoxidation step and hence redeposition of the tar matter on the fibers under heat treatment was also scanty and the obtained oxidized fiber had a good quality.

TABLE 1

| flow chart | the drawings | Corresponding (°C.) | Reference numeral of oxidation furnace in (min.) | Oxidation step Temp. (%) | Oxidation step Time (Nm³/hr)** | Water retention of fiber from oxidation step (Nm³/hr)** | Hot air(*) circulation rate (Nm³/hr)** | Exhaust gas rate from furnace (Nm³/hr)** | rate in Fresh air feed | Gas flow discharge line |
|---|---|---|---|---|---|---|---|---|---|---|
| Example 1 | Test No. 1 | FIG. 1 | 1 (preoxidation) | 220 | 30 | 2.5 | 30000 | 4500 | 3000 | 4500 |
| | | | 2 | 260 | 30 | 7.5 | 30000 | 1500 | 1500 | |
| | Test No. 2 | FIG. 2 | 1 (preoxidation) | 240 | 10 | 2.5 | 10000 | 3000 | 1000 | 3000 |
| | | | 2 | 250 | 50 | 7.5 | 50000 | 2000 | 2000 | |
| | Test No. 3 | FIG. 3 | 1 (preoxidation) | 240 | 10 | 2.5 | 10000 | 3000 | 500 | 3000 |
| | | | 2 | 240 | 20 | 4.5 | 20000 | 1000 | 1000 | |
| | | | 14 | 255 | 30 | 7.5 | 30000 | 1500 | 1500 | 6000 |
| Comparative Example 1 | | FIG. 4 | 1 (preoxidation) | 240 | 30 | 4.5 | 30000 | 4500 | 4500 | |
| | | | 2 | 255 | 30 | 7.5 | 30000 | 1500 | 1500 | |

| Corresponding flow chart | | Fluffing of oxidized fiber (fluffs/m) | Break of fiber in continuous one-month run (number of times of break per month) | Cleaning time required after continuous one-month run (number of persons × days) | Heater power required for continuous one-month run (Kw) | Kerosine consumption (l/hr) | | |
|---|---|---|---|---|---|---|---|---|
| Example 1 | Test No. 1 | FIG. 1 | 15 | 23 | 15 | −100 | 90 | |
| | Test No. 2 | FIG. 2 | 3 | 3 | 3 | −200 | 60 | |
| | Test No. 3 | FIG. 3 | 3 | 2 | 4 | −200 | 60 | |
| Comparative Example 1 | | 15 | 25 | 15 | (given as reference) | 120 | | |

(*)gas flow rate through gas lines 7, 7', 7" or 8, 8', 8" in FIGS. 2 to 5.
*Nm³ means m³ under normal conditions (0° C., 1 atm.)

It was also noted that the exhaust gas treatment employing the process of this invention was low in kerosene consumption.

EXAMPLE 2 AND COMPARATIVE EXAMPLE 2

The same acrylic fiber as used in Example 1 and Comparative Example 1 but containing 2.5% by weight of a blended oil composed of 20 parts by weight of dimetylaminosiloxane and 80 parts by weight of a hydrocarbon oil was used as precursor and subjected to the oxidation treatment in the same way as in Example 1 and Comparative Example 1. The exhaust gas from the preoxidation step was mixed with kerosine as combustion aid and directly subjected to the burning treatment.

The fluids of the obtained oxidized fibers, workability and energy consumption are shown in Table 2.

As shown in Table 2, Test Nos. 4, 5 and 6 which embody the present invention were small in energy consumption, while Test Nos. 5 and 6 with a shortened preoxidation treatment were limited in fluffs of the oxidized fibers and excellent in workability. The properties of the carbon fibers obtained in accordance with the Example 2 and Comparative Example 2 are also shown in Table 2.

EXAMPLE 3

The oxidized fibers obtained according to Test No. 1 of Example 1 were carbonized in the precarbonization and carbonization atmosphere using nitrogen as inert gas and maintained at a temperature of 350° to 1,300° C. to produce carbon fibers.

The exhaust gases from said precarbonization and carbonization steps were mixed with the one from the preoxidation step at a ratio of the former to the latter of 1/5, and the mixed gas was subjected to a burning treatment. In practicing this treatment, the preoxidation exhaust gas was introduced into the burning equipment by keeping said gas at a temperature of 230° C. while the exhaust gas from the precarbonization step was kept at 470° C. The oxygen concentration of the preoxidation exhaust gas was 20% and the calorific value of the precarbonization and carbonization exhaust gases was 850 kcal/m$^3$ under normal conditions (0° C., 1 atm.).

The above-described mixed gas burned by itself at 760° C. with no feed of fuel such as kerosene nor oxidizing gas such as air. Also, no environmental pollutants such as ammonia was detected in the exhaust from the combustion furnace. Further, no condensation of tar matter was observed in any of the treating steps and exhaust gas lines, and a stable operation could be attained.

The obtained carbon fibers had a strength of 360 kg/mm$^2$ and a modulus of elasticity of 23.5 tons/mm$^2$.

EXAMPLES 4 AND 5, AND COMPARATIVE EXAMPLES 3 AND 4

Carbon fibers were produced according to Example 3 but by varying as shown in Table 3 the carbonization exhaust gas to peoxidation exhaust gas ratio, the oxygen concentration in the preoxidation exhaust gas, the calorific value of the precarbonization and carbonization exhaust gas, and the temperatures at which the preoxidation exhaust gas and precarbonization exhaust are maintained till fed into the combustion furnace.

According to the method of this invention (Examples 4 and 5), the whole carbon fiber production process could be performed with high stability and also the combustion treatment of the mixed exhaust gas could be accomplished with no feed of kerosene and air.

In Comparative Example 3, no sufficient calorific value was provided for the amount of the mixed exhaust gas, causing a drop in the temperature in the combustion furnace for the treatment of exhaust gas, resulting in incomplete oxidative destruction of gas components such as ammonia, and it was necessary to add kerosene for elevating the temperature in said combustion furnace to a level sufficient to allow normal operation of the exhaust gas treatment. In Comparative Example 4, the tar matter in the exhaust gas was condensed on the exhaust gas ducts, the oxidation furnace and the carbonization furnace, resulting in fiber breakage when the condensed tar matter became attached to the fibers. Thus, a stable operation was impossible, and the obtained carbon fibers were found to be very low in strength.

TABLE 3

| | Oxidation exhaust gas/carbonization exhaust gas | Oxygen concentration in oxidation exhaust gas (%) | Calorific value of precarbonization and carbonization exhaust gas (kcal/Nm$^3$)* | Maintained temperature of oxidation exhaust gas (°C.) | Maintained temperature precarbonization exhaust gas (°C.) | Properties of carbon fiber | |
|---|---|---|---|---|---|---|---|
| | | | | | | Strength (kg/mm$^2$) | Modulus of elasticity tons/mm$^2$ |
| Example 4 | 2 | 20 | 400 | 230 | 470 | 355 | 23.4 |
| Example 5 | 10 | 15 | 1200 | 250 | 500 | 370 | 23.7 |
| Comparative Example 3 | 20 | 20 | 850 | 230 | 470 | 365 | 23.5 |
| Comparative Example 4 | 5 | 20 | 850 | 180 | 400 | 280 | 23.0 |

*Nm$^3$ means m$^3$ at normal conditions (0°C., 1 atm.).

EXAMPLE 6

The oxidized fibers obtained according to Test No. 6 of Example 2 were fed into a vertical (low-temperature) carbonization furnace as shown in FIG. 5 at a rate of 5 m/min for the carbonization treatment. In this operation, the inert gas (nitrogen gas) feed rate was 120

TABLE 2

| | Corresponding flow chart | Corresponding flow chart | Fluffing of oxidized fiber (fluffs/m) | Break of fiber in continuous one-month run (number of times of break per month) | Cleaning time required after continuous one-month run (persons × days) | Heater power required for continuous one-month run (Kw) | Kerosene consumption (l/hr) |
|---|---|---|---|---|---|---|---|
| Example 2 | | | | | | | |
| Test No. 4 | Test No. 1 | FIG. 1 | 18 | 15 | 12 | −100 | 90 |
| Test No. 5 | Test No. 2 | FIG. 2 | 2 | 1 | 3 | −200 | 60 |
| Test No. 6 | Test No. 3 | FIG. 3 | 2 | 1 | 4 | −200 | 60 |
| Comparative Example 2 | Comparative Example 1 | FIG. 4 | 20 | 17 | 12 | (reference) | 120 |

$Nm^3/hr$, the take-out rate 40 $Nm^3/hr$ and take-out temperature 450° C.

The fibers drawn out from the furnace top were then treated in a nitrogen gas atmosphere at 1,400° C.

The examination of the workability and quality of the thus obtained carbon fibers gave the results shown in Table 4.

TABLE 4

| Number of times of fiber break per day | Number of fluffs produced per meter | Strength ($kg/mm^2$) |
|---|---|---|
| 0.1 | 10 | 430 |

When the gas exhausted from the central part of the vertical carbonization furnace was mixed with the exhaust gas from the preoxidation furnace in Test No. 1 of Example 1, the mixed gas showed a good combustibility and could be subjected to the burning treatment without supply of any combustion aid such as kerosene or fresh air.

COMPARATIVE EXAMPLE 6

Carbon fiber was produced according to Example 6 except that the take-out of the exhaust gas was effected at block A (800° C.) or block C (350° C.).

The workability and quality of the obtained carbon fiber were as shown in Table 5.

TABLE 5

| No. | Take-out of exhaust gas | Fiber break frequency (number of times of break per day) | Number of fluffs produced per meter | Strength ($kg/mm^2$) |
|---|---|---|---|---|
| 1 | Block A | 0.1 | 25 | 350 |
| | | | The exhaust gas from the vertical low-temperature carbonization furnace was heated red hot to cause a damage to the furnace. | |
| 2 | Block B | 130 | 80 | 300 |
| | | | The carbides dropped from the bottom of the vertical low-temperature carbonization furnace and the continuous operation was difficult. | |

We claim:

1. A process for producing carbon fiber comprising a preoxidation step in which precursor fibers are heated in an oxidizing atmosphere of about 200° to 250° C. to convert them into partially oxidized fibers with a water retention of 1 to 3% by weight, an oxidation step in which the partially oxidized fibers are heated in an oxidizing atmosphere to convert them into oxidized fibers, and a carbonization step in which the oxidized fibers obtained in said oxidation step are further heated in an inert atmosphere to convert them into carbonized fibers, wherein part or the whole of the exhaust gas from the oxidation step (oxidation exhaust gas) is supplied into said preoxidation step as the oxidizing gas for said preoxidation treatment, and the exhaust gas from said preoxidation step is subjected to a burning treatment.

2. The process of claim 1 wherein the oxidation exhaust gas supplied into the preoxidation step is one which has undergone a catalyst treatment.

3. The process of claim 1 or 2 wherein the oxidizing atmosphere gas supplied into said preoxidation step is one mixed with fresh air in an amount of 0 to 4 parts (by volume) of air to one part (by volume) of the exhaust gas from the oxidation step.

4. The process of claim 1 wherein the exhaust gas from the preoxidation step is mixed with the one from the carbonization step and the gas mixture is subjected to a burning treatment.

5. The process of claim 4 wherein the exhaust gas from the preoxidation step contains about 0.01 to 2.0 $g/m^3$ under normal conditions (0° C., 1 atm.) of pyrolyzates and oxidation products and also has a calorific value of 5 to 20 $kcal/Nm^3$, an oxygen concentration of at least 12% and a temperature of about 200° to 350° C.

6. The process of claim 4 wherein the carbonization exhaust gas has a calorific value of at least 320 kcal $g/m^3$ under normal conditions (0° C., 1 atm.).

7. The process of claim 4 wherein the ratio by volume of the exhaust gas from the carbonization step to the one from the preoxidation step is 1 to 15.

8. The process of claim 1 wherein the precursor fiber is an acrylonitrile fiber treated with silicone oil.

9. The process of claim 8 wherein the amount of said silicone oil is within the range from 0.1 to 5% by weight.

* * * * *